US009348274B2

(12) United States Patent
Koga

(10) Patent No.: US 9,348,274 B2
(45) Date of Patent: May 24, 2016

(54) IMAGE FORMING APPARATUS

(71) Applicant: CANON KABUSHIKI KAISHA, Tokyo (JP)

(72) Inventor: Yutaka Koga, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/717,147

(22) Filed: May 20, 2015

(65) Prior Publication Data

US 2015/0338796 A1 Nov. 26, 2015

(30) Foreign Application Priority Data

May 22, 2014 (JP) ..... 2014-105848

(51) Int. Cl.
*G03G 15/20* (2006.01)

(52) U.S. Cl.
CPC ..... *G03G 15/2025* (2013.01)

(58) Field of Classification Search
CPC ..... G03G 2215/00337; G03G 15/60; G03G 15/6511; G03G 15/602; G03G 2215/00185; G03G 2215/00396; G03G 2215/004; G03G 2221/1645
See application file for complete search history.

(56) References Cited

U.S. PATENT DOCUMENTS

2003/0147665 A1* 8/2003 Ahn ..... G03G 21/206 399/92
2014/0161481 A1* 6/2014 Udagawa ..... G03G 21/206 399/92

FOREIGN PATENT DOCUMENTS

JP 2010-217580 9/2010
JP 2011-112708 6/2011

* cited by examiner

*Primary Examiner* — Roy Y Yi
(74) *Attorney, Agent, or Firm* — Fitzpatrick, Cella, Harper & Scinto

(57) ABSTRACT

An image forming apparatus includes: an image forming device; a fixing device; a first feeding path configured to discharge the recording material so that a fixed toner image is directed upwardly; a second feeding path, branching from the first feeding path, configured to discharge the recording material so that the fixed toner image is directed downwardly; a first rotatable member pair, provided in the first feeding path, configured to discharge the recording material; a second rotatable member pair, provided in the second feeding path, configured to discharge the recording material; a first air-blowing mechanism configured to blow air so as to cross the second feeding path when the recording material is discharged using the first feeding path; and a second air-blowing mechanism configured to blow air so as to cross the first feeding path when the recording material is discharged using the second feeding path.

11 Claims, 11 Drawing Sheets

(i)

(ii)

IMAGE FORMING APPARATUS

FIELD OF THE INVENTION AND RELATED ART

The present invention relates to an image forming apparatus such as a copying machine, a printer or a facsimile machine.

In recent years, in the image forming apparatus of an electrophotographic type or the like, in order to improve a parting property of a sheet-like recording material from a fixing member, a fixing device employs an oil-less fixing type in which a toner image is formed with a toner containing a parting agent (wax).

In this oil-less fixing type, according to Japanese Laid-Open Patent Application 2010-217580, a paraffin wax contained in the toner is volatilized at a nip or the like of the fixing member and is deposited on an induction heating potion opposing the fixing member. When the a deposition amount of the wax reaches a certain amount or more, there is the problem that the wax is deposited on the fixing member and then is transferred from the fixing member onto the recording material. Therefore, a cleaning means for liquefying and discharging the fixed paraffin wax by a heat generating member, which generates heat by energization, is provided.

Japanese Laid-Open Patent Application 2011-112708 discloses that fine particles are generated from a fixing device and a toner. Therefore, a cleaning web contacting the fixing member includes a trapping material for trapping the fine particles.

The parting wax contained in the toner is vaporized when the toner is heated by the fixing device of the image forming apparatus, and thereafter is cooled in the air to condense, and thus changes into dust of about several tens of nm. This dust can be deposited on recording material feeding members (rotatable member pair) provided in the neighborhood of the fixing device. As a result, there is a liability that the dust is transferred from the recording material feeding members onto the recording material and adversely affects an image.

SUMMARY OF THE INVENTION

According to an aspect of the present invention, there is provided an image forming apparatus comprising: an image forming device configured to form a toner image on a recording material with a toner containing a parting agent; a fixing device configured to fix the toner image formed on the recording material by the image forming device; a first feeding path configured to discharge the recording material so that the toner image fixed by the fixing device is directed upwardly; a second feeding path, branching from the first feeding path, configured to discharge the recording material so that the toner image fixed by the fixing device is directed downwardly; a first rotatable member pair, provided in the first feeding path, configured to discharge the recording material; a second rotatable member pair, provided in the second feeding path, configured to discharge the recording material; a first air-blowing mechanism configured to blow air so as to cross the second feeding path when the recording material is discharged using the first feeding path; and a second air-blowing mechanism configured to blow air so as to cross the first feeding path when the recording material is discharged using the second feeding path.

According to another aspect of the present invention, there is provided an image forming apparatus comprising: an image forming device configured to form a toner image on a recording material with a toner containing a parting agent; a fixing device configured to fix the toner image formed on the recording material by the image forming device; a first feeding path configured to discharge the recording material so that the toner image fixed by the fixing device is directed upwardly; a second feeding path, branching from the first feeding path, configured to discharge the recording material so that the toner image fixed by the fixing device is directed downwardly; a first rotatable member pair, provided in the first feeding path, configured to discharge the recording material; a second rotatable member pair, provided in the second feeding path, configured to discharge the recording material; a first fan configured to form an air curtain so as to partition between the fixing device and the rotatable member pair on the second feeding path when the recording material is discharged using the first feeding path; and a second fan configured to form an air curtain so as to partition between the fixing device and the first rotatable member pair the first feeding path when the recording material is discharged using the second feeding path.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiment 1

(1) Image Forming Portion

Figure 2:
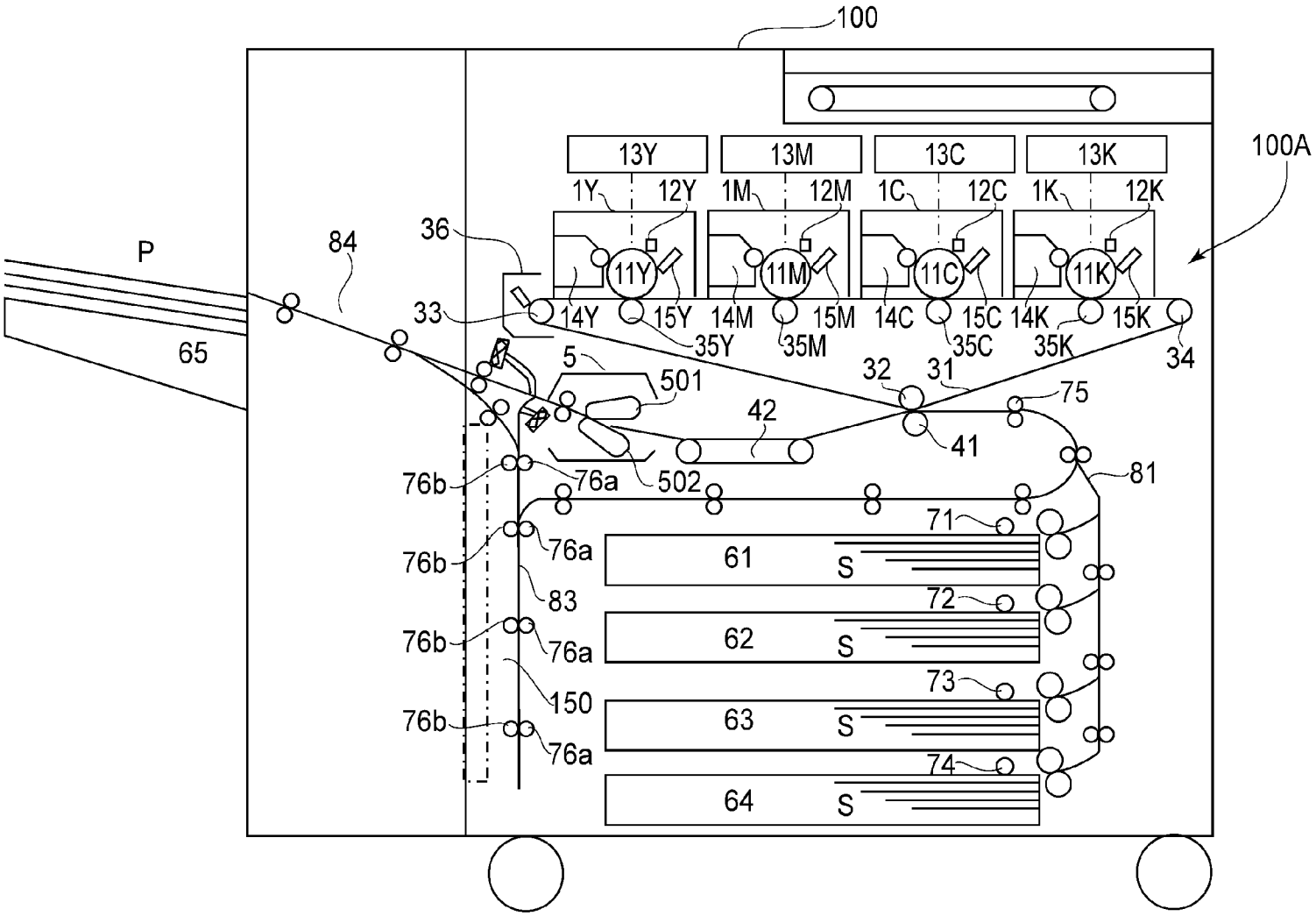
FIG. 2 is a schematic sectional view of an example of an image forming apparatus.

FIG. 2 is a longitudinal front view showing a general structure of an image forming apparatus 100 in this embodiment. The image forming apparatus 100 is an intermediary-transfer type, full-color image forming apparatus of a tandem type in which image forming portions 1Y, 1M, 1C and 1K are provided in line at a horizontal portion of an intermediary transfer belt 31. Depending on an image signal sent from a host device 300 ((a) of FIG. 3) to a controller (control portion: CPU) 200, a full-color image is formed on a sheet-like recording material (sheet) S as a recording medium by an electrostatic process.

The host device 300 is a personal computer (PC), an image reader or the like which are network-connected to the controller 200. The host device 300 may also include an original reading device mounted on the image forming apparatus 100.

The image forming portions (image forming devices) 1Y, 1M, 1C and 1K form toner images of yellow, cyan, magenta and black on photosensitive drums 11Y, 11M, 11C and 11K, respectively, and then the toner images are primary-transferred onto the intermediary transfer belt 31 in the same position. Each of the toners contains a parting agent such as paraffin wax.

The intermediary transfer belt 31 is stretched and rotated by a driving roller 33, a tension roller 34 and a transfer opposite roller 32 for performing secondary transfer. In an inner peripheral surface side of the intermediary transfer belt 31, at positions opposing the photosensitive drums 11Y, 11M, 11C and 11K, primary transfer rollers 35Y, 35M, 35C and 35K for performing primary transfer are respectively provided.

At a periphery of the photosensitive drum 11Y for forming a yellow toner image, a charging device 12Y for electrically charging the surface of the photosensitive drum 11Y uniformly and an exposure device 13Y for forming a latent image on the surface of the photosensitive drum 11Y by irradiating the surface of the photosensitive drum 11Y with imagewise light are provided. Further, a developing device 14Y for forming the toner image by transferring the toner onto the latent image on the photosensitive drum 11Y and a cleaning device 15Y for removing the toner remaining on the photosensitive drum 11Y after the primary transfer of the toner image are provided. A constitution for forming the toner images of magenta, cyan and black can be understood by replacing the suffix Y with M, C and K, respectively, in the above description of forming the yellow toner image.

The sheets S accommodated in sheet feeding cassettes 61, 62, 63 and 64 are fed to a sheet feeding path 81, including a registration roller pair 75, by rotating sheet feeding rollers 71, 72, 73 and 74, respectively. The registration roller pair 75 feed the sheet S to a secondary transfer portion formed by contact between a secondary transfer roller 41 and the transfer opposite roller 32, while being timed to the arrival of the toner image on the intermediary transfer belt 31. An image forming mechanism portion 100A until the secondary transfer portion is an image forming means for forming the (unfixed) toner image on the sheet S.

The sheet S on which the toner images are transferred at the secondary transfer portion is fed to a fixing device 5 by a feeding belt 42, and the toner image is heated and pressed by the fixing device 5. As a result, the toner images are fixed as a full-color image on the surface of the sheet S.

The fixing device 5 in this embodiment uses, as a fixing member, an endless fixing belt 501 and an endless pressing belt 502. At a fixing nip 501*a* (FIG. 1) formed by the belts 501 and 502, the sheet S on which the (unfixed) toner images are carried is nipped and fed, so that the toner images are fixed under the application of heat and pressure. The fixing device 5 is an oil-less fixing device having such a constitution. The fixing device 5 itself is well known, and therefore a detailed description thereof is omitted.

Figure 1:
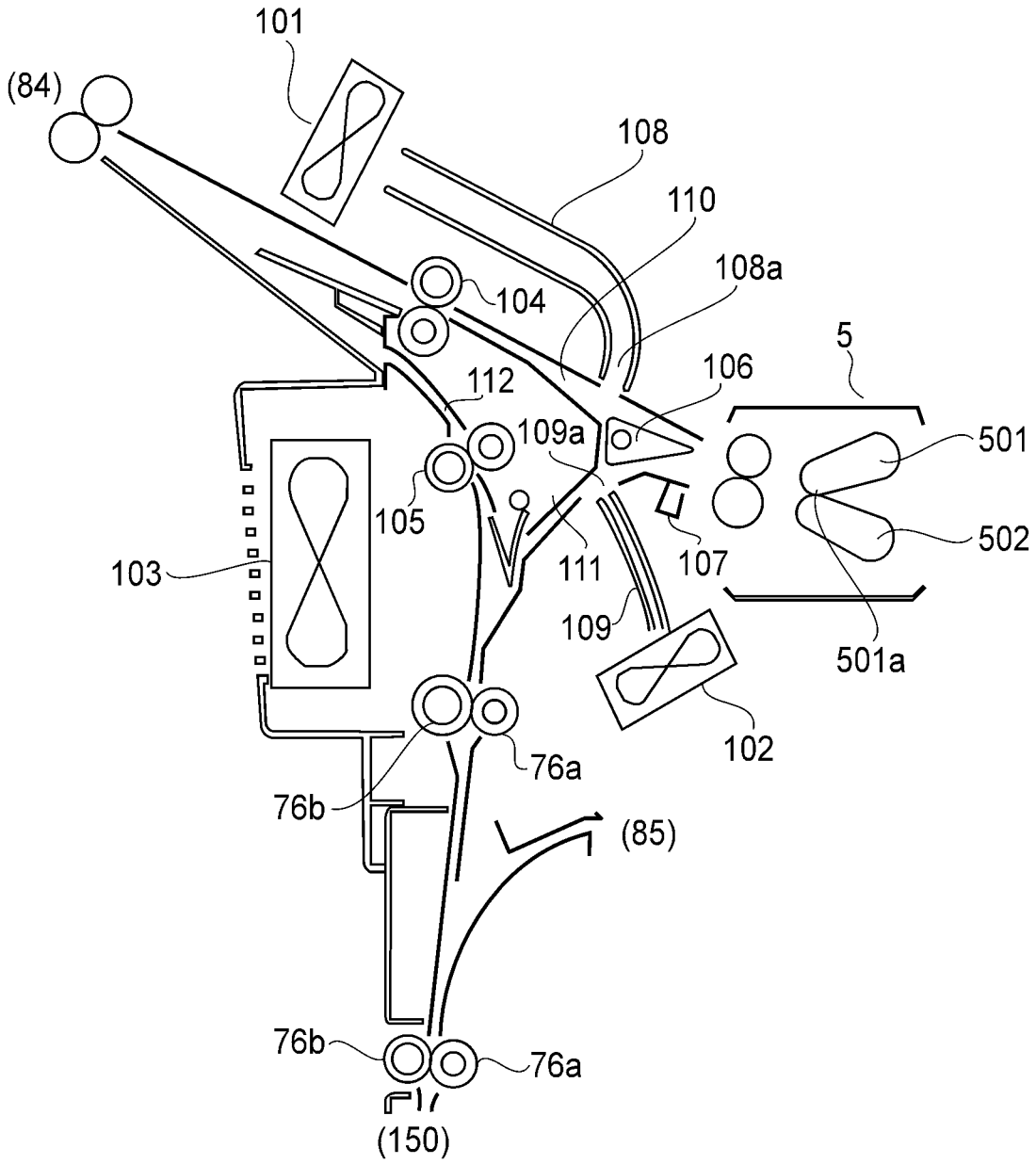
FIG. 1 is a schematic view of a principal part of a sheet feeding portion of a fixing device and a sheet feeding portion in the rear of the fixing device.

FIG. 1 is a partly enlarged view of the fixing device 5 and a sheet feeding portion (recording material feeding portion, recording material feeding device) in the rear of the fixing device 5. A sheet trailing end detecting sensor 107, provided downstream of the fixing device 5 with respect to a sheet feeding direction, for detecting a trailing end of the sheet S is provided. The sheet S coming out of the fixing device 5 is sent toward a first feeding path 110 side by a properly selecting the operation of a flapper 106 in the case of a one-side image forming mode. The sheet S is relayed by a first feeding roller pair (first recording material feeding roller pair, image rotatable member pair 104 provided in a first feeding path 110, and then is sent toward a discharge tray (stacking portion) 65 through a buffer feeding path 84.

The first feeding path 110 is a face-up feeding path used during an operation in a face-up mode (first mode) in which the sheet which comes out of the fixing device 5 and on which an image-fixed surface is directed upward (face-up), is discharged onto the discharge tray 65 while keeping the image-fixed surface directed upward. Hereinafter, the first feeding path 110 is also referred to as an FU feeding path (first feeding path). Further, discharge of the sheet S by the FU feeding path is referred to as FU discharge.

In the case of a double-side image forming mode, the sheet S, which comes out of the fixing device 5 and on which the image has already been formed on a first surface (front surface), is sent toward a second feeding path 111 side by the properly selecting the operation of the flapper 106. Then, the sheet S is pulled into a switch-back path 150 by feeding roller pairs (reversing roller pairs) 76*a* and 76*b*. Then, the rotational direction of the feeding roller pairs 76*a* and 76*b* is reversed (switch-back operation), so that leading and trailing ends of the sheet S are reversed and then the sheet S is fed to a feeding path 85 for double-side image formation.

The sheet S fed to the feeding path 85 is fed to the sheet feeding path 81 including the registration roller pair 75 again, and then is sent to the secondary transfer position through the registration roller pair 75 in a state in which the sheet S is turned upside down. An image forming process with respect to a back surface (second surface) side of the sheet S is similar to that in the above-described case of the front surface (first surface) side. Thereafter, the sheet S passes through the feeding path similar to that in the case of the one-side image forming mode, and then is sent as a double-side image-formed product onto the sheet discharge tray 65 (FU discharge: discharge of the sheet on which the second surface is directed upward).

In the one-side or double-side image forming mode, the sheet S can also be discharged (reversely discharged) onto the sheet discharge tray 65 in a state of a so-called face-down sheet discharge (referred to as FD discharge), in which the image forming surface is a lower surface (the second surface is a lower surface with respect to double-side image formation).

That is, the sheet S is turned upside down by the second feeding path 111 (together with a part of the first feeding path 110) so that the image-fixed surface coming out of the fixing device 5 is directed downward (face-down). The second feeding path 111 is the face-down feeding path used during an operation in a face-down mode (second mode) in which the sheet S is then discharged onto the sheet discharge tray 65. Hereinafter, the second feeding path 111 is referred also to as an FD feeding path.

In this case, the sheet S coming out of the fixing device 5 is pulled into the switch-back path 150 by changing the course thereof toward the second feeding path 111 side by properly selecting the operation of the flapper 106. The sheet S is reversely fed by reverse rotation of the feeding roller pairs 76*a* and 76*b* to enter a third feeding path 112 and then is relayed by a second feeding roller pair (second recording material feeding roller pair, second rotatable member pair)

105 provided in the third feeding path 112. Then, the sheet S passes through the buffer feeding path 84 and is sent toward the sheet discharge tray 65.

That is, the trailing end of the sheet S, when the sheet S is pulled into the switch-back path 150 from the second feeding path 111, reversed, and then is discharged onto the sheet discharge tray 65 in a direction opposite to the feeding direction. As a result, the sheet S is reversely discharged onto the sheet feeding tray 65. The sheet feeding tray 65 is a common stacking portion (discharge portion) in each of the above-described operations in the image forming modes.

The second feeding path 111 and the third feeding path 112 constitute a face-down feeding path (second feeding path: hereinafter referred to as an FD feeding path), which branches from the FU feeding path 110, for reversely feeding the sheet S so that the image-fixed surface is directed downward and then for discharging the sheet S. Further, the discharge of the sheet S by the FU feeding paths 111 and 112 is referred to as FD discharge.

(2) Parting Wax

Next, a parting wax (parting agent) contained in the toner will be described. In the image forming apparatus 100 using the toner, the toner causes a phenomenon called offset in which the toner is deposited on a fixing belt 501 in some cases.

Therefore, in the image forming apparatus in this embodiment, the parting wax is incorporated in the toner, so that the parting wax bleeds out from the toner during heat fixing. The parting wax melted by the heating is positioned at an interface between the fixing belt 501 and the toner image on the sheet S, and thus has the function of preventing the offset.

The melting point Tm of the parting wax is about 75° C. In the case where the temperature of the fixing nip 501*a* is maintained at a target set temperature of 170° C., the melting point Tm is set so that the parting wax in the toner instantaneously melts and bleeds out at the interface between toner image and the fixing belt 501. When the parting wax melts, a part of the parting wax, such as a low-molecular weight component, is vaporized. The parting wax is constituted by a long-chain molecular component, but the length thereof is not uniform and has a certain distribution. That is, in the parting wax, the low-molecular weight component having a short chain and a low boiling point, and a high-molecular weight component having a long chain and a high boiling point, are co-present in the mixture, and the low-molecular weight component as the part of the parting wax is vaporized.

The vaporized wax component (hereinafter referred to as wax dust) is cooled in the air and then is condensed, thus being changed into dust of a size of about several tens of nm to about several hundreds of nm. A specific wax dust generation mechanism will be described with reference to (a) to (f) of FIG. 4.

(a): The sheet S on which an unfixed toner 112*s* is transferred is fed to the fixing device 5.

(b): The toner is fixed (112*f*) on the sheet by the fixing device 5. At this time, a part of the wax contained in the toner is parted from the toner and is deposited (113) on the fixing belt 501 at the same time.

(c) to (e): When the unfixed toner 112*s* transferred on the sheet S is fixed again, the wax 113 is deposited again on the surface of the fixing belt 501 simultaneously with the parting, but a part 113*p* of the wax 113 is transferred onto the sheet.

Figure 4:
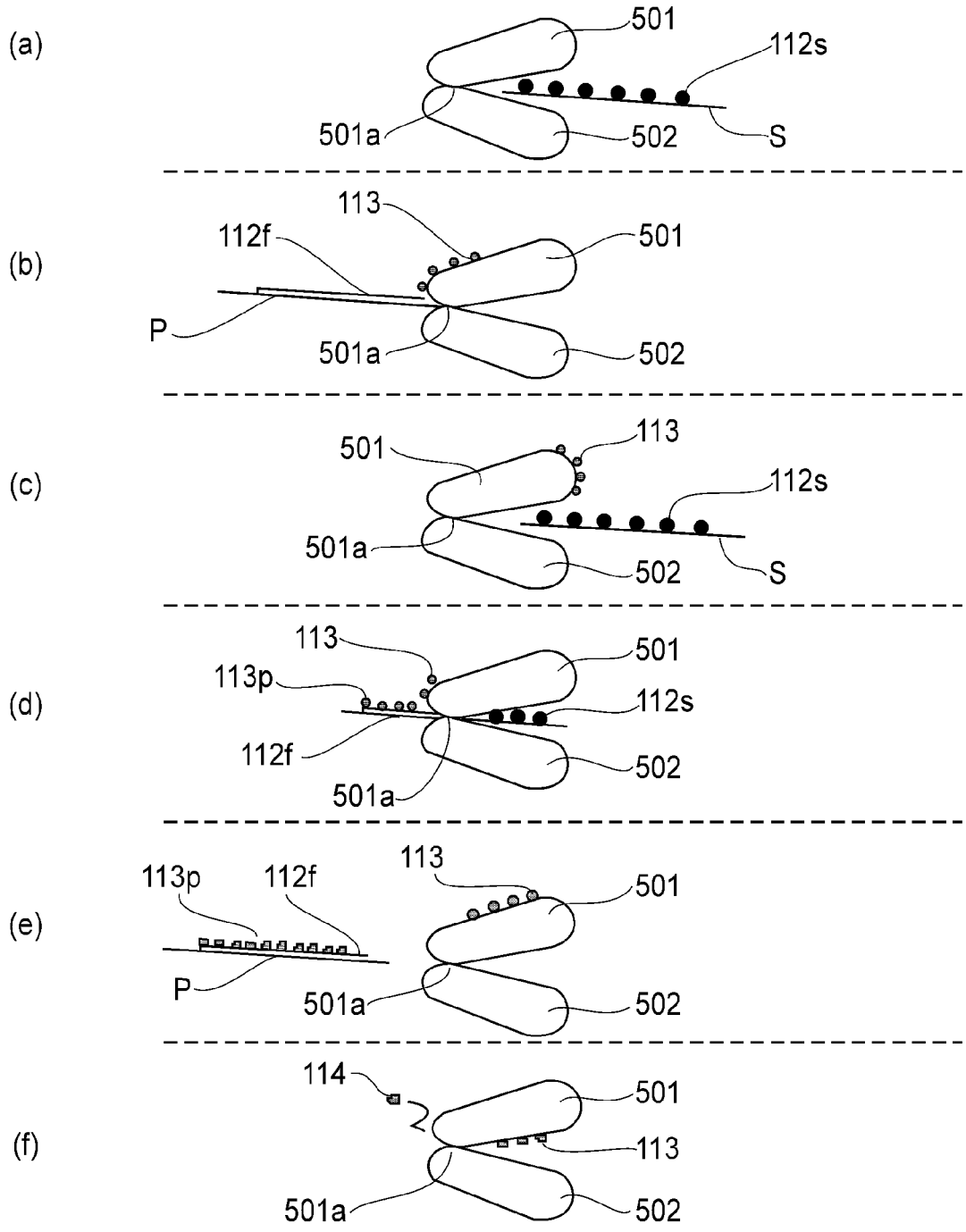
In FIG. 4, (a) to (f) are schematic views for illustrating a dust generating mechanism.

The cycle shown in FIG. 4 (a) to (d) is repeated for every fixing of the toner image on the sheet S, so that the wax 113 is transferred between the surface of the fixing belt 501 and the sheet S during the fixing, and as shown in (e) of FIG. 4, a certain amount wax 113 remains on the surface of the fixing belt 501.

However, in the case where subsequent printing is not effected continuously from the preceding printing, the wax 113 on the fixing belt 501 after the fixing of the toner on the last sheet cannot be transferred onto the sheet, and therefore has no place to go. In addition, the loss of heat taken from the fixing device 5 by the sheet does not occur, and therefore the temperature of the fixing belt 501 temporarily increases. For that reason, of the wax 113 on the fixing belt 501, the wax having the short molecular chain exceeds the boiling point in temperature, and is vaporized as wax dust 114 as shown in (f) of FIG. 4. By a phenomenon with a series of toner fixing steps, when continuous printing of one sheet or more is effected, the wax dust 114 generated after the toner is fixed on the final sheet.

Figure 6:
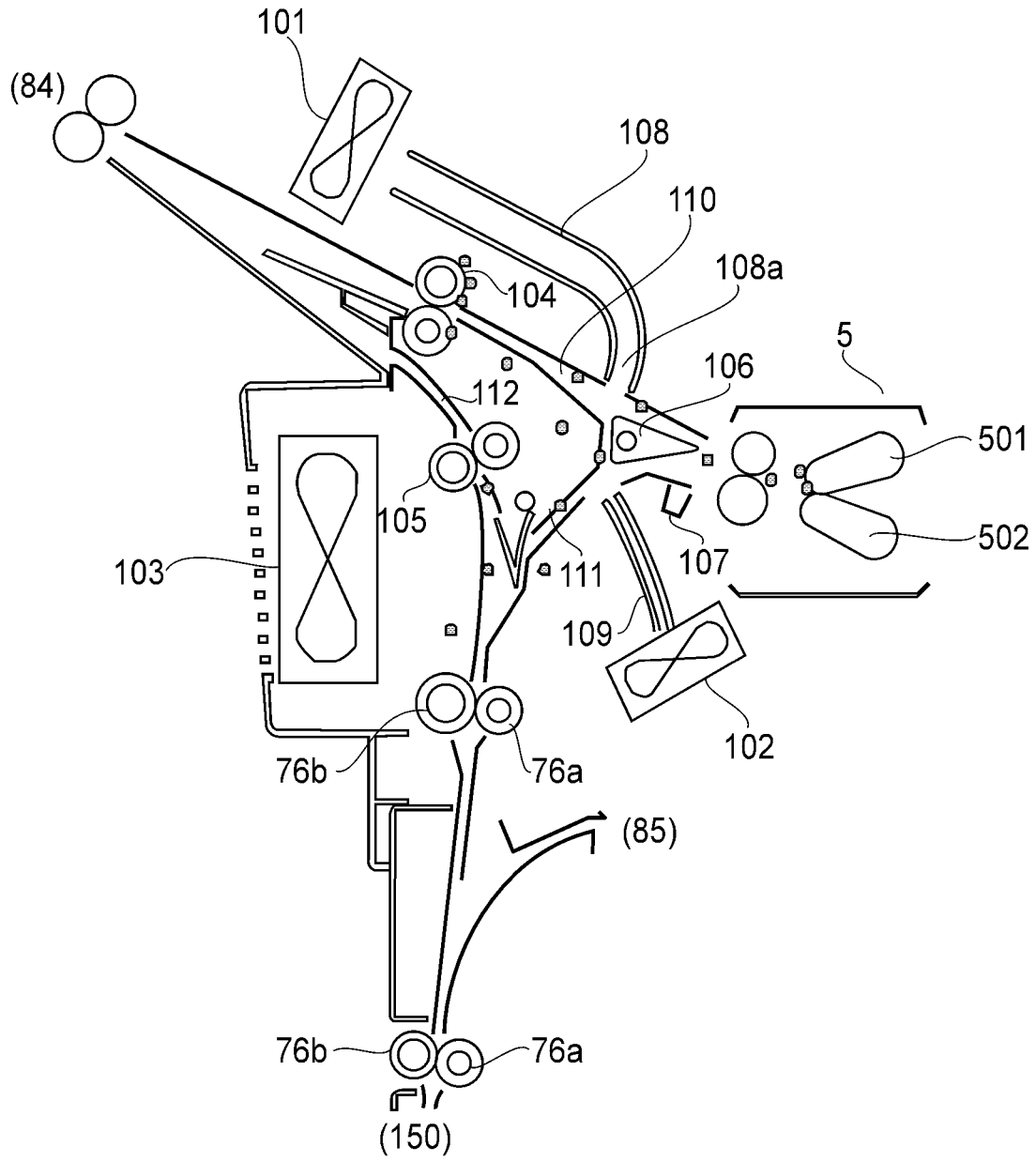
FIG. 6 is an illustration of a dust path before the provision of a countermeasure.

In a state (before any countermeasure is taken) in which air flow control as in this embodiment described later is not effected, the wax dust 114 generated from the fixing device 5 diffuses from the fixing device 5 toward a downstream side with respect to a sheet feeding direction as shown in FIG. 6. Then, the wax dust 114 is deposited on the sheet feeding roller pairs 104 and 105 in the FU feeding path 110 and the FD feeding paths 111 and 112. When the printing is effected in the state in which the wax is deposited on the sheet feeding roller pairs (rotatable member pairs) 104 and 105, the wax on the feeding belt surface is transferred onto the sheet during the sheet passing, so that an image defect due to contamination with the wax is generated on the image.

Therefore, in this embodiment, a plurality of air-blowing mechanisms for the FU feeding path 110 and the FD feeding paths 111 and 112, are sheet feeding portions, are disposed at the rear of the fixing device 5. Then, the parting wax 114 vaporized in the fixing device 5 is controlled by air flow generated by the air-blowing mechanisms, so that the deposition of the parting wax 114 on the feeding roller pairs 104 and 105 is prevented.

In order to below the air toward the FU feeding path 110, a first fan (first air-blowing mechanism) 101, a duct 108 for permitting blowing of the air from the first fan 101, and an air blowing part 108*a*, are provided between the fixing device 5 and the first feeding roller pair 104.

Similarly, in order to blow the air toward the second feeding path 111 and the third feeding path 112 which constitute the FD feeding path, a second fan (second air-blowing mechanism) 102, a duct 109 for permitting blowing of the air from the second fan 102 and an air blowing point 109*a* are provided between the fixing device 5 and the second feeding roller pair 105. Further, a third fan (exhaust fan) 103 is provided in the neighborhood of the third feeding path 112. Specifically, the third fan (exhausting mechanism) 103 is disposed for exhausting air in the neighborhood of the feeding roller pairs 104 and 105 to outside of the image forming apparatus.

In the following, a control method of the air-blowing mechanisms 101, 102 and 103 will be specifically described. The first fan 101 and the second fan 102 blow the air toward the FU feeding path 110 in order to cool the sheet S coming out of the fixing device 5 after the fixing. The third fan 103 exhausts vapor, evaporated by the fixing device 5 from water contained in the sheet S, to the outside of the image forming apparatus.

The first, second and third fans 101, 102 and 103 are stopped in a stand-by state in which the image forming apparatus 100 does not effect the image formation. The air flow rate of each of the first, second and third fans 101, 102 and 103 can be arbitrarily changed in a range of 0-100% of their rated output by variable voltage control, which is called PWM control.

Figure 3:
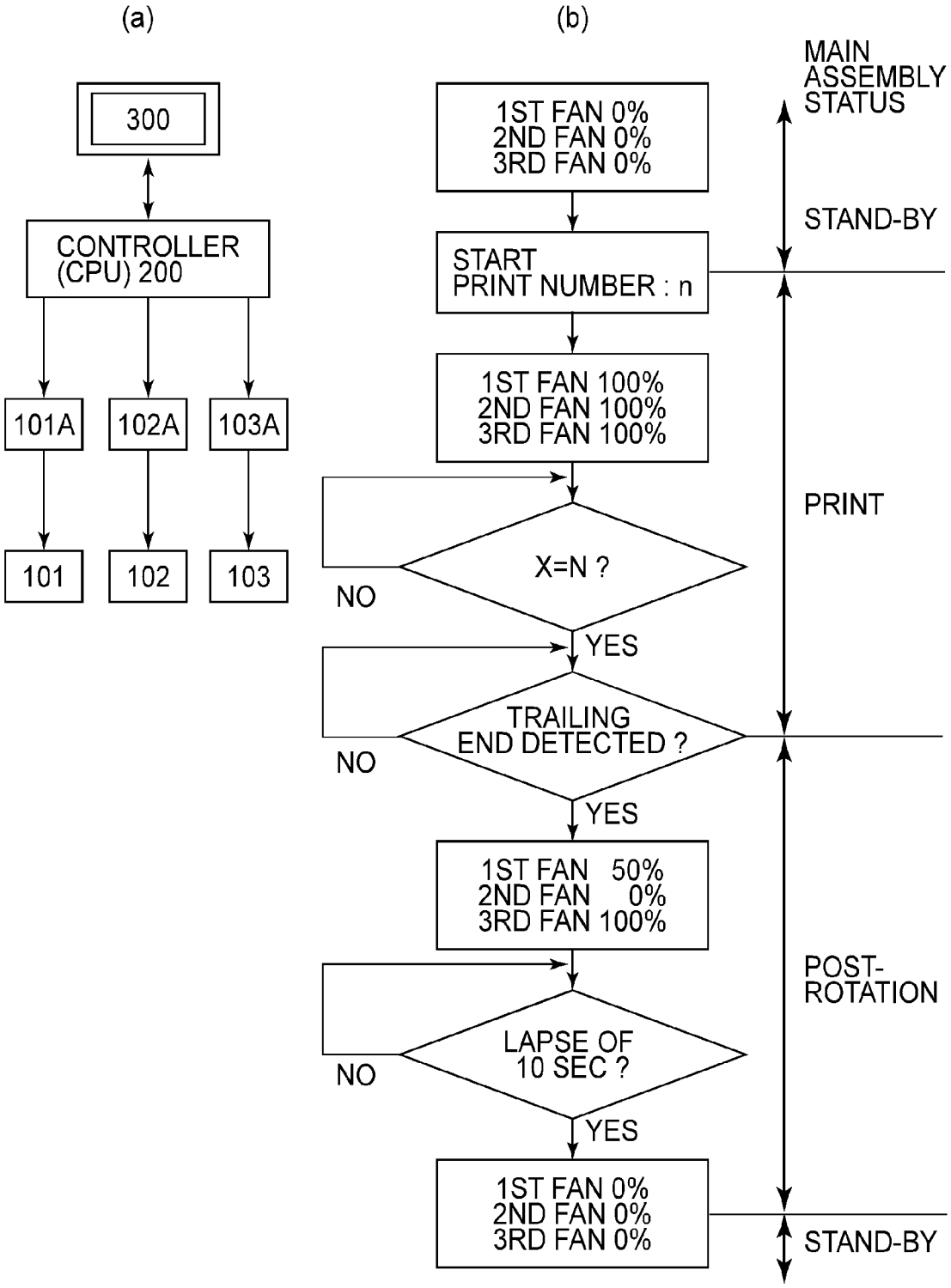
In FIG. 3, (a) is a block diagram of a control system, and (b) is a control flowchart.

When a controller 200 ((a) of FIG. 3) provides a print instruction (job) of n sheets, the image forming apparatus 100 starts an image forming operation of the print job from the stand-by state. The controller 200 drives the first, second and third fans 101, 102 and 103 via fan drivers 101A, 102A and 103A, respectively, at 100% of a rated voltage to blow the air toward the feeding paths 110, 111 and 112.

In this embodiment, the above-described fan control is effected in accordance with the sequence shown in (b) of FIG. 2. After the controller 200 provides the image formation instruction of n sheets, a trailing end of the final sheet (paper) in the job is detected by a sheet end portion detecting sensor 107 provided downstream of the fixing device 5 with respect to the sheet feeding direction. Then, the air flow amount of the second fan 102 for cooling the sheet S is 0% (stopped).

The time from the detection of the trailing end of the sheet by the sheet end portion detecting sensor 107 until the image forming apparatus is changed again to the stand-by state for starting a next job is referred to as a post-rotation time. At this time, the first and third fans 101 and 103 continue their operation while keeping the rated operation at 100%.

Figure 7:
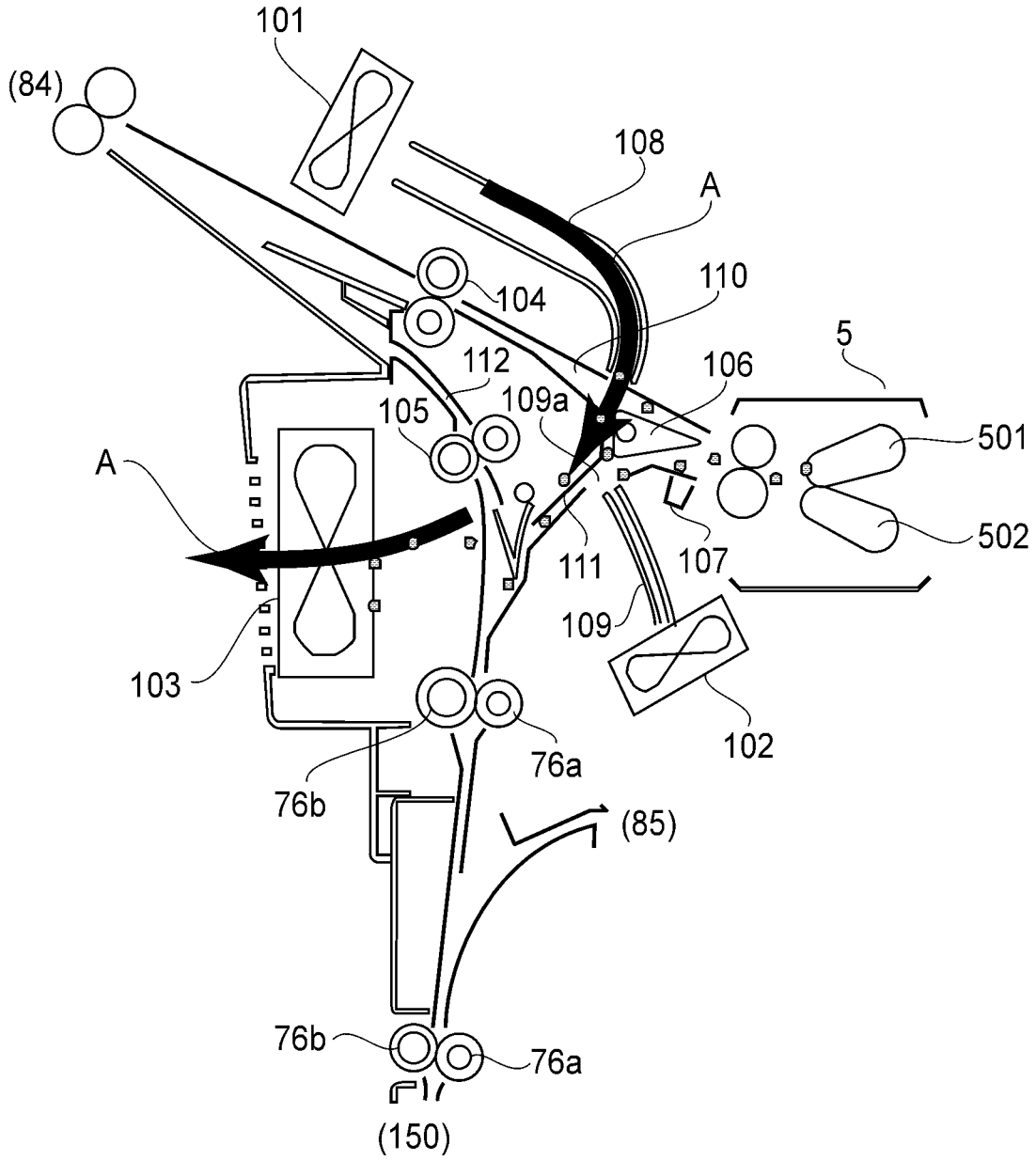
FIG. 7 is an illustration of a dust path by air flow in Embodiment 1.

The air flow in this case is shown in FIG. 7, where the air is sent by the first fan 101 and is evacuated by the third fan 103, so that air flow A is generated between the fixing device 5 and each of the first and second feeding roller pairs 104 and 105, and functions as an air curtain. As a result, it is possible to effectively discharge the wax dust 114 scattering in the image forming apparatus. The third fan 103 may preferably be provided with a filter for collecting the wax dust 114.

The formation of the air curtain means that the air is blown (i.e., the air flow is formed) by the fan so as to block (cross) the recording material feeding path. As a result, in the air blowing region as a boundary, the air flow from an upstream side and the downstream side of the recording material feeding direction is blocked. In this embodiment, a constitution in which the air flow is not sufficiently blocked may also be employed within a range to not adversely affect the image quality by deposition of the vaporized wax, generated in a large amount in the fixing step, on the feeding roller pairs 104 and 105.

When a predetermined time elapses from the detection of the trailing end of the final paper in the job by the sheet end portion detecting sensor 107, the image forming apparatus 100 is changed in state to the stand-by state again. When the image forming apparatus 100 is changed in state to the stand-by state, the first and third fans 101 and 103 are stopped.

The above-described constitutions of the feeding paths and the air-blowing mechanisms are summarized as follows. The first feeding path 110 for discharging the recording material S so that the image fixed by the fixing device 5 is directed upward and the second and third feeding paths 111 and 112 for discharging the recording material S so that the image fixed by the fixing device 5 is directed downward are provided. The first rotatable member pair 104 for discharging the recording material S is provided along the first feeding path 110, and the second rotatable member pair 105 for discharging the recording material S is provided along the second feeding paths 111 and 112. The first rotatable member pair 104 for discharging the recording material S is provided along the first feeding path 110, and the second rotatable member pair 105 for discharging the recording material S is provided along the second feeding paths 111 and 112.

When the recording material S is discharged using the first feeding path 110, in order to blow the air so as to cross the second and third feeding paths 111 and 112, the first air-blowing mechanisms 101 and 108 are provided. When the recording material S is discharged using the second and third feeding paths 111 and 112, in order to blow the air so as to cross the first feeding path 110, the second air-blowing mechanisms 102 and 109 are provided.

The first air-blowing mechanisms 101 and 108 are disposed on a part of the first feeding path 110 from which the second and third feeding paths 111 and 112 branch, and the second air-blowing mechanisms 102 and 109 are disposed on a part of the second feeding path 111 which branches from the first feeding path 110 and which is connected to the second air-blowing mechanism 102.

When the recording material S is discharged using the first feeding path 110, the first fan 101 forms the air curtain at a position on the second and third feeding paths 111 and 112 and between the fixing device 5 and the second rotatable member pair 105. When the recording material S is discharged using the second and third feeding paths 111 and 112, the second fan 102 forms the air curtain at a position on the first feeding path 110 and between the fixing device 5 and the first rotatable member pair 104. When the recording material S is discharged using the second feeding paths 111 and 112, the second fan 102 forms the air curtain at a position on the first feeding path 110 and between the fixing device 5 and the first rotatable member pair 104.

In this way, the controller 200 is operable in a control mode in which the rate (amount) of the air flow generated from each of the plurality of air-blowing mechanisms is switched stepwise after the sheet S is discharged through the FU feeding path 110 or the FD feeding paths 111 and 112.

Figure 5:
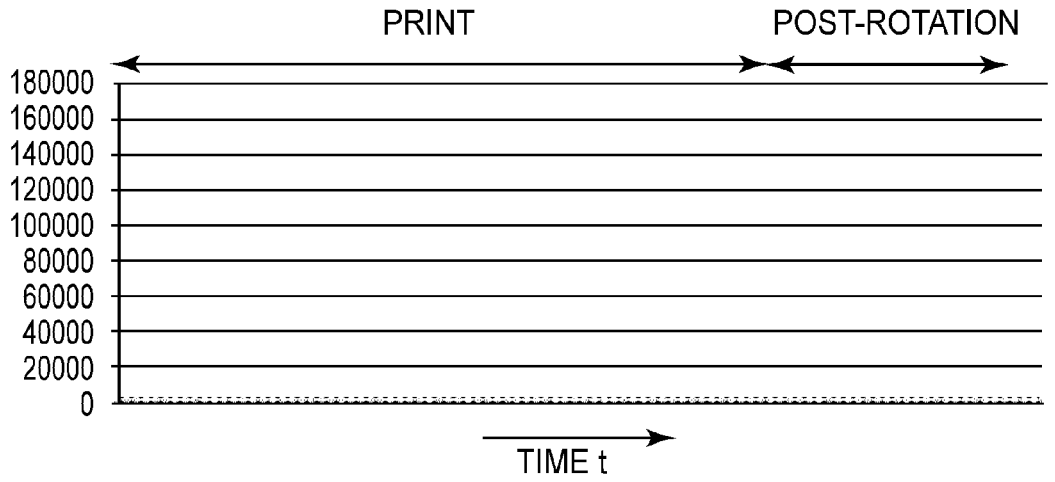
In FIG. 5, (i) and (ii) each illustrate a dust measurement result, in which (i) shows the result in Embodiment 1 (after countermeasure) and (ii) shows the result in a comparison example (before countermeasure).
Figure 5:
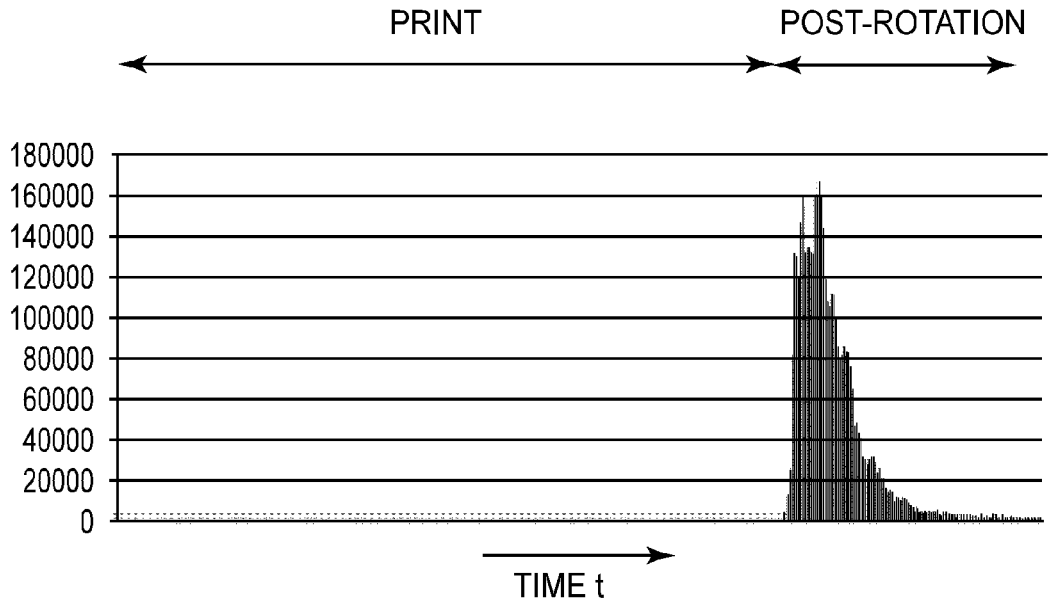

In order to check the effect of the above-described fan sequence, the wax dust density (concentration) in the neighborhood of the first and second feeding roller pairs 104 and 105 was measured using a fast mobility particle sizer ("FMPS", manufactured by TSI Inc.). The result is shown in FIG. 5. In FIG. 5, (i) shows the case where the fan sequence in this embodiment is performed (after the countermeasure is taken), and (ii) shows the case where the first and third fans 101 and 103 are stopped (before the countermeasure is taken).

When (i) and (ii) are compared, it is understood that the wax dust is detected in (ii) in the neighborhood of the first and second feeding roller pairs 104 and 105 after the job is ended. On the other hand, in (i), the wax dust is not detected. In the fan sequence in this embodiment, the wax dust generated from the fixing device 5 is blocked by an air curtain effect by the air blowing from the first and second fans 101 and 102. That is, the wax dust is discharged to the outside of the image forming apparatus by the third fan 103 without reaching the first and second feeding roller pairs 104 and 105, so that it is possible to confirm such an effect that the deposit of the wax dust is prevented.

Embodiment 2

Embodiment 2 will be described. As described above, the image forming apparatus 100 is operable in the two sheet discharging modes including the case of the FU discharge and the case of the FD discharge in which the sheet is fed to the reverse discharging portion by switching the flapper 106 and then is switched-back to be discharged with the image surface downward. In the case of the FU discharge, the sheet S coming out of the fixing device 5 is passed through the FU feeding path 110. In the case of the FD discharge, the sheet S is passed through the FD feeding paths 111 and 112. The feeding paths are provided with the first and second feeding roller pairs 104 and 105, respectively, until the FU feeding path 110 and the FD feeding paths 111 and 112 merge with each other.

As described in Embodiment 1, after the toner image is fixed on the sheet S, by stepwise controlling the air flow rate of the plurality of fans 101, 102 and 103, it is possible to alleviate a scattering amount of the wax dust in the image forming apparatus. Of the reduced dust amount, the amount of the wax deposited at one time is slight, and therefore even when the wax is transferred from the feeding roller surface onto the sheet, the wax dust does not appear as a contamination of the image with the wax, and the wax deposited onto the feeding roller surface is removed by the sheet passing.

However, in the case of such a feeding path that the FU feeding path 110 and the FD feeding paths 111 and 112 are separated from each other, e.g., when the sheets are continuously passed in the operation in the FU discharging mode, the sheets are not passed through the FD feeding paths 111 and 112 during the operation. For that reason, the wax is not removed by the sheet passing and the scattered wax dust accumulates on the second feeding roller pair 105 in the fixing device discharging path. When the FD discharge is effected in the wax accumulation state, the wax accumulating on the second feeding roller pair 105 until then is transferred onto the sheet at one time, so that an image defect due to contamination with the wax is caused.

Figure 9:
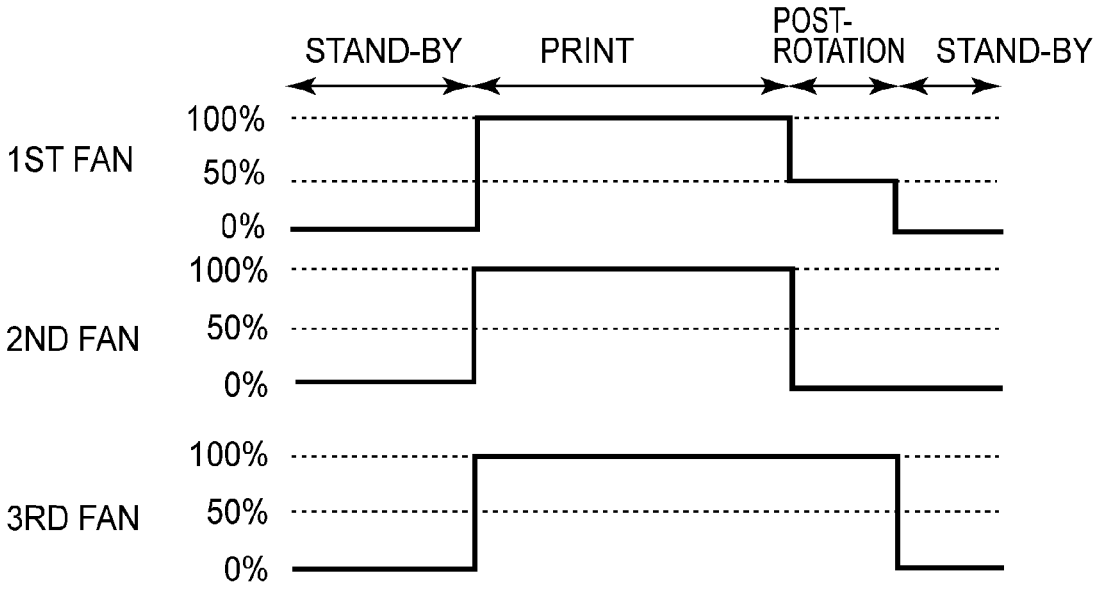
FIG. 9 is an illustration of a fan sequence during FD discharge in Embodiment 2.
Figure 10:
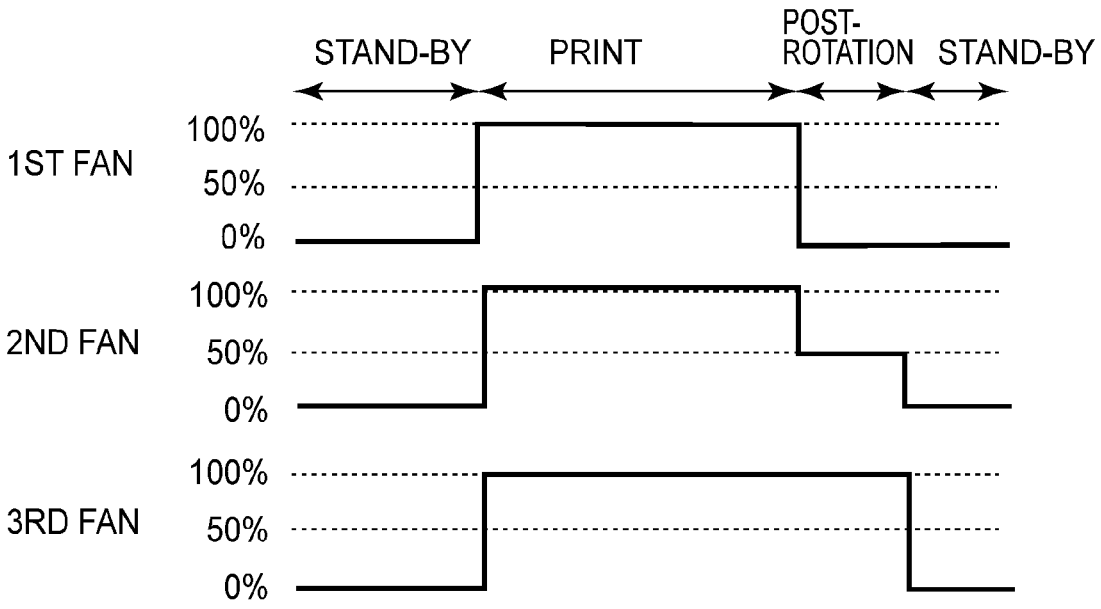
FIG. 10 is an illustration of a fan sequence during FU discharge in Embodiment 2.

In this embodiment, in order to solve the above problem, depending on the FD discharge and the FU discharge, control of the fans is performed by the fan sequence shown in FIGS. 9 and 10, respectively.

(a) FD Discharge (FIG. 9)

When the FD discharge is selected, the sheet S is passed through the second and third feeding paths 111 and 112, which are the FD feeding paths. During the post-rotation, the first fan 101 is operated at 50%, and the second fan 102 is stopped. The wax dust generated from the fixing device 5 is blocked by the air flow, and is not deposited on the first feeding roller pair 104.

By the air flow generated by the first fan 101, the wax dust is carried in a direction toward the second feeding roller pair 105 and is deposited in a slight amount on the second feeding roller pair 105. However, by passing the sheet through the second feeding roller pair 105, the dust is transferred from the feeding roller pair 105 onto the sheet. The dust in the slight amount does not reach a visible level as the contamination of the image with the dust.

In the case where there is no air flow by the first fan 101, the scattered wax dust is deposited on the first feeding roller pair 104 in the first feeding path 110, which is the FU feeding path through which the sheet is not passed. In the case where the FU discharge is selected in the wax dust accumulation state, the dust deposited on the image surface is transferred at one time, and thus constitutes a visible image contamination.

(b) FU Discharge (FIG. 10)

Figure 8:
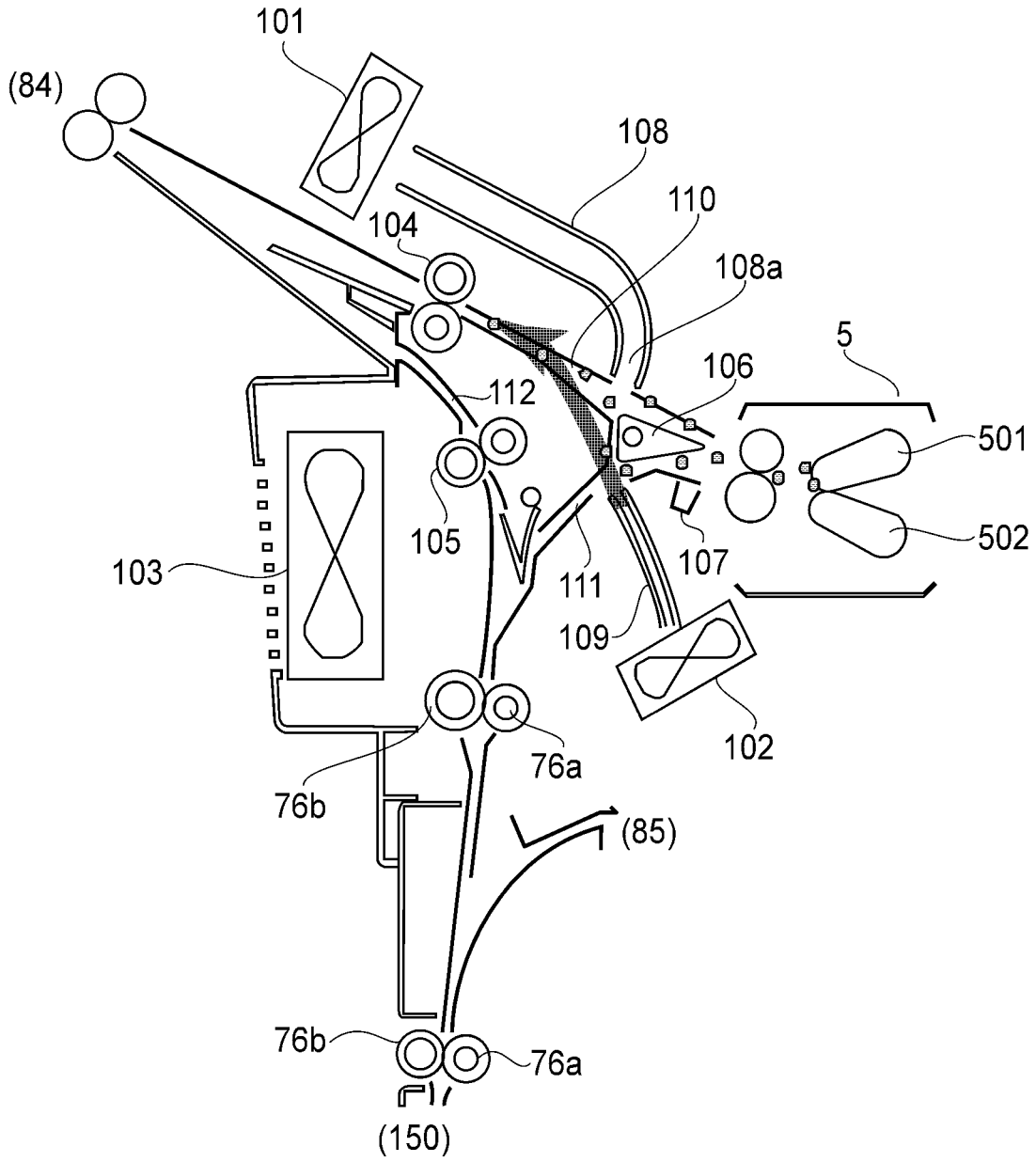
FIG. 8 is an illustration of a dust path by air flow in Embodiment 2.

In the case where the FU discharge is selected, the sheet S is passed through the first feeding path 110 which is the FU feeding path and is not passed through the second feeding roller pair 105 in the FD feeding paths 111 and 112. Therefore, during the post-rotation, the second fan 102 having the air blowing port on the second feeding path 111 is continuously operated at 50%, and the first fan 101 is stopped. As shown in FIG. 8, the wax dust scattered toward the FD feeding paths 111 and 112 is carried toward the first feeding path 110 by the air flow generated by the second fan 102, and therefore does not reach the second feeding roller pair 105. Even after the user selects the FU discharge to perform continuous printing of a large amount of sheets, the accumulation of the wax on the second feeding roller pair 105 does not occur.

In this way, the controller 200 is operable in the control mode in which the sheet S is cooled by operating either one of the plurality of air-blowing mechanisms described above during the sheet passing through the FU feeding path 110 or the FD feeding paths 111 and 112.

As described above, depending on the sheet discharging mode, the first fan 101 and the second fan 102 are selectively operated. As a result, even when the user effects continuously the printing in the operation in either of the modes of the FD discharge and the FU discharge, it becomes possible to prevent the accumulation of the wax on the feeding roller pair through which the sheet is not passed.

Embodiment 3

Similarly as in Embodiment 2, in the case where the second fan 102 is operated at 100% during the post-rotation, and the first fan 101 is stopped during the post-rotation.

Figure 12:
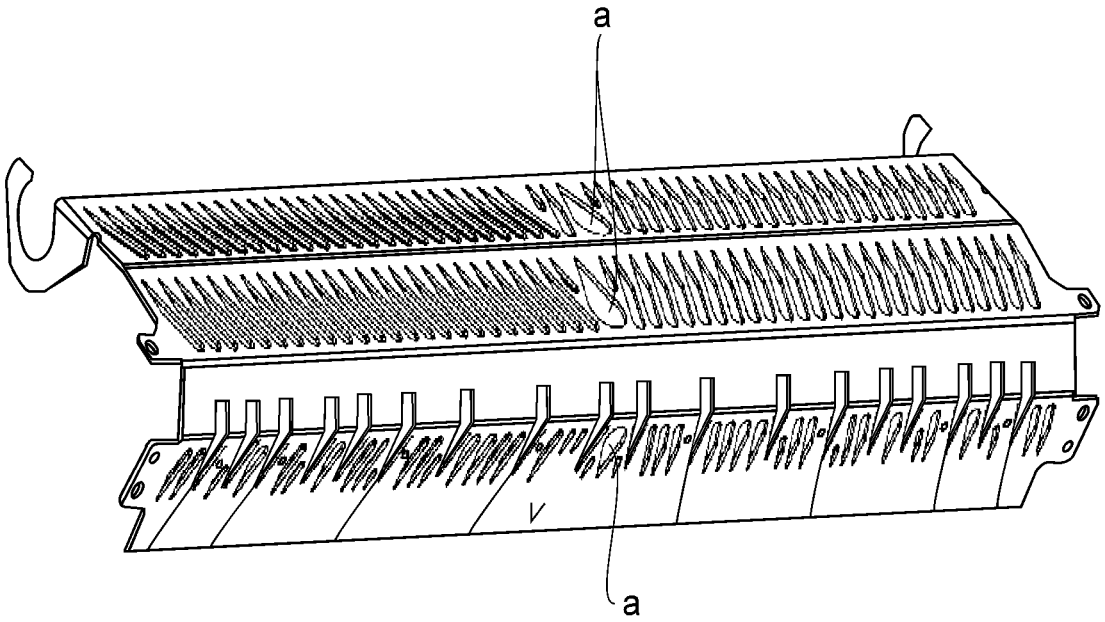
FIG. 12 is a perspective view of a feeding guide of the second feeding path in Embodiment 3.

In order to prevent water contained in the sheet from vaporizing to condense on the feeding path, each of the FU feeding path 110 and the FD feeding paths 111 and 112 is provided with slits (vent holes) for permitting air flow through a feeding guide constituting the feeding path. FIG. 12 is a perspective view of the feeding guide constituting the second feeding path 111 in this embodiment. During the FU discharge, by operating the second fan 102, deposition of the wax dust on the second feeding roller pair 105 is prevented. However, when the above-described slits a are provided, the wax dust carried by air flow from the second fan 102 passes through the slits to be deposited on the second feeding roller pair 105 in some cases.

Figure 11:
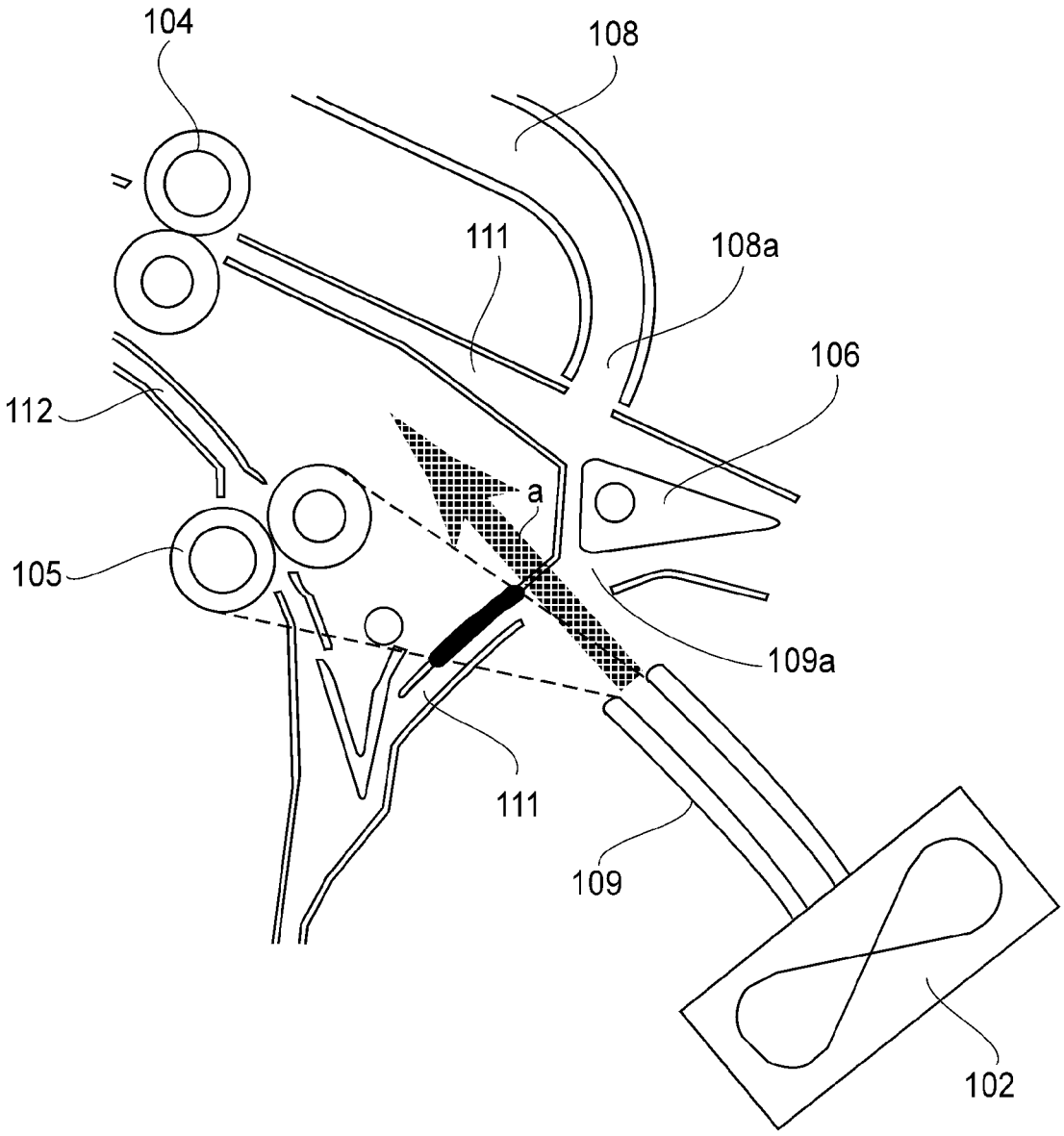
FIG. 11 is a sectional view of a second feeding path in Embodiment 3.

Therefore, in this embodiment, in order to compatibly realize, a condensation prevention and a wax dust deposition preventing effect, as shown in FIG. 11, the slits a are provided so as to avoid a projected portion of the air blow port 102*a*, of the second fan 102 provided over the second feeding path, onto the second feeding roller pair 105.

That is, with respect to the recording material feeding roller pair and the air blow port formed on or over the same feeding path of the FU feeding path 110 and the fixing device feeding paths 111 and 112, the feeding path in the recording material feeding roller pair is provided with the vent holes a at a position excluding the projected portion from the air blow port 102*a* onto the recording material feeding roller pair.

As a result, although the slits for preventing the condensation is provided, it is possible to prevent the deposition of the wax dust, due to the air flow formed by the second fan 102 during the FU discharge, on the second feeding roller pair 105.

Other Embodiments (1) The image forming apparatus is not limited to the full-color laser beam printer including the plurality of photosensitive drums as in the above embodiments, but may also be an image forming apparatus, such as a monochromatic copying machine or printer provided with a single photosensitive drum.

(2) The image forming portion of the image forming apparatus is not limited to that of the electrophotographic type. The image forming apparatus may also be an image forming apparatus for forming the toner image on the sheet using an image forming principle or method of direct transfer type or other known transfer types such as electrostatic recording type and magnetic recording type.

(3) The fixing device 5 may also be configured to include a roller pair consisting of a fixing roller and a pressing roller which are used in place of the fixing belt 501 and the pressing belt 502, respectively. It is also possible to employ a fixing device constitution in which either one of the fixing member and the pressing member is an endless belt and the other is a roller member.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-105848 filed on May 22, 2014, which is hereby incorporated by reference herein in its entirety.

What is claimed is:

1. An image forming apparatus comprising:

an image forming device configured to form a toner image on a recording material with a toner containing a parting agent;

a fixing device configured to fix the toner image formed on the recording material by said image forming device;

a first feeding path configured to discharge the recording material so that the toner image fixed by said fixing device is directed upwardly;

a second feeding path, branching from said first feeding path, configured to discharge the recording material so that the toner image fixed by said fixing device is directed downwardly;

a first rotatable member pair, provided in said first feeding path, configured to discharge the recording material;

a second rotatable member pair, provided in said second feeding path, configured to discharge the recording material;

a first air blowing mechanism configured to blow air so as to cross said second feeding path when the recording material is discharged using said first feeding path;

a second air blowing mechanism configured to blow air so as to cross said first feeding path when the recording material is discharged using said second feeding path; and a controller configured to control an operation of said first air blowing mechanism and an operation of said second air blowing mechanism, wherein said controller operates said first air blowing mechanism without operating said second air blowing mechanism when the recording material is discharged using said first feeding path without using said second feeding path, and operates said second air blowing mechanism without operating said first air blowing mechanism when the recording material is discharged using said second feeding path.

2. An image forming apparatus according to claim 1, further comprising a common stacking portion configured to stack the recording material discharged using the first feeding path and the recording material discharged during the second feeding path.

3. An image forming apparatus according to claim 2, wherein said first feeding path is configured to merge with said second feeding path at a position downstream of said first rotatable member pair with respect to a recording material feeding direction.

4. An image forming apparatus according to claim 1, further comprising an exhausting mechanism configured to exhaust air in a neighborhood of said first rotatable member pair and said second rotatable member pair.

5. An image forming apparatus according to claim 1, wherein said second air blowing mechanism blows the air so as to cross a part of said first feeding path from which said second feeding path has already branched.

6. An image forming apparatus according to claim 1, wherein each of said first air blowing mechanism and said second air blowing mechanism includes a fan.

7. An image forming apparatus comprising:

an image forming device configured to form a toner image on a recording material with a toner containing a parting agent;

a fixing device configured to fix the toner image formed on the recording material by said image forming device;

a first feeding path configured to discharge the recording material so that the toner image fixed by said fixing device is directed upwardly;

a second feeding path, branching from said first feeding path, configured to discharge the recording material so that the toner image fixed by said fixing device is directed downwardly;

a first rotatable member pair, provided in said first feeding path, configured to discharge the recording material;

a second rotatable member pair, provided in said second feeding path, configured to discharge the recording material;

a first fan configured to form an air curtain so as to partition a space between said fixing device and said rotatable member pair on said second feeding path when the recording material is discharged using said first feeding path;

a second fan configured to form an air curtain so as to partition a space between said fixing device and said first rotatable member pair said first feeding path when the recording material is discharged using said second feeding path; and a controller configured to control an operation of said first fan and an operation of said second fan, wherein said controller operates said first fan without operating said second fan when the recording material is discharged using said first feeding path without using said second feeding path, and operates said second fan without operating said first fan when the recording material is discharged using said second feeding path.

8. An image forming apparatus according to claim 7, further comprising a common stacking portion configured to stack the recording material discharged using the first feeding path and the recording material discharged during the second feeding path.

9. An image forming apparatus according to claim 8, wherein said first feeding path is configured to merge with said second feeding path at a position downstream of said first rotatable member pair with respect to a recording material feeding direction.

10. An image forming apparatus according to claim 7, further comprising an exhausting fan configured to exhaust air in a neighborhood of said first rotatable member pair and said second rotatable member pair.

11. An image forming apparatus according to claim 7, wherein said second air blowing mechanism blows the air so as to cross a part of said first feeding path from which said second feeding path has already branched.

* * * * *